US006045887A

United States Patent [19]

Martin et al.

[11] Patent Number: 6,045,887

[45] **Date of Patent: *Apr. 4, 2000**

[54] ABRASIVE SHEETS

[75] Inventors: Michael Martin, Darlington; Colin Pugh, Wingate; Eric Cockburn, Binchester Moor, all of United Kingdom

[73] Assignee: Black & Decker Inc., Newark, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,199

[22] Filed: Mar. 6, 1997

Related U.S. Application Data

[63] Continuation of application No. 08/516,188, Aug. 18, 1995, abandoned.

[30] Foreign Application Priority Data

Aug. 25, 1994 [GB] United Kingdom ..... 9417272

[51] Int. Cl.[7] ..... B32B 3/02; B32B 3/10

[52] U.S. Cl. ..... 428/43; 428/99; 428/100; 428/131; 428/141; 428/143; 451/527; 451/529

[58] Field of Search ..... 428/43, 99, 100, 428/131, 141, 143; 451/527, 526, 531, 529, 538, 539

[56] References Cited

U.S. PATENT DOCUMENTS

| | | | |
|---|---|---|---|
| D. 235,244 | 6/1975 | Stoppacher . | |
| D. 355,105 | 2/1995 | Nemazi . | |
| D. 389,388 | 1/1998 | Longstaff et al. . | |
| 449,930 | 4/1891 | Dubrey . | |
| 1,139,541 | 5/1915 | Krug . | |
| 1,635,350 | 7/1927 | Simons | 451/527 |
| 2,815,617 | 12/1957 | Berkstein . | |
| 4,274,232 | 6/1981 | Wylde . | |
| 4,930,267 | 6/1990 | Hill et al. . | |
| 5,123,216 | 6/1992 | Kloss et al. . | |
| 5,170,595 | 12/1992 | Wiand . | |
| 5,197,998 | 3/1993 | Germain . | |
| 5,398,457 | 3/1995 | Updegrave et al. . | |
| 5,437,571 | 8/1995 | Everts et al. . | |
| 5,533,926 | 7/1996 | Nemazi . | |

FOREIGN PATENT DOCUMENTS

| | | |
|---|---|---|
| 0280786 | 9/1988 | European Pat. Off. . |
| 0610801 | 8/1994 | European Pat. Off. . |
| 2275007 | 8/1994 | United Kingdom . |

OTHER PUBLICATIONS

E.P.O. Notice of Opposition dated Feb. 23, 1996 including First Opposition Statement (and English–language translation).

*Primary Examiner*—Alexander Thomas
*Attorney, Agent, or Firm*—Charles E. Yocum; Dennis A. Dearing; John D. Del Ponti

[57] ABSTRACT

An abrasive sheet 1 for a sanding or polishing machine, comprising a body portion 3 and a tip portion 5 providing a working point 11, the tip portion 5 being defined by a weakened region 7 between the body portion 3 and the tip portion 5, wherein the tip portion 5 can be separated from the body portion 3, turned through an angle (FIG. 2) and re-positioned adjacent the body portion 3 to change the working point 11. As a result, an iron-shaped abrasive sheet, for example, can be provided with a plurality of working points 11. The sheet can, therefore, be used for longer periods before it is worn out.

9 Claims, 1 Drawing Sheet

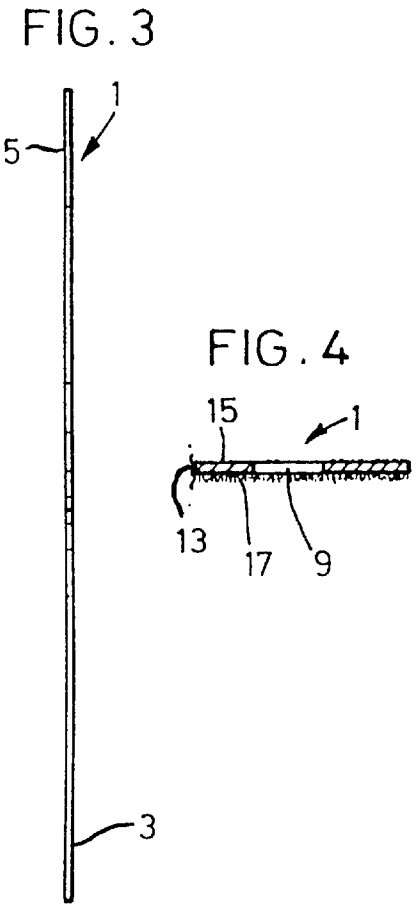
FIG. 3
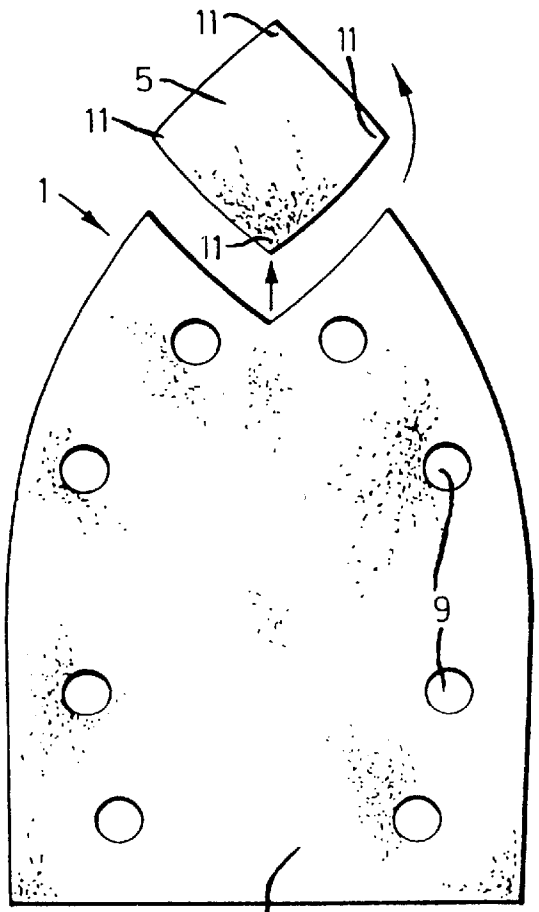
FIG. 4
FIG. 2
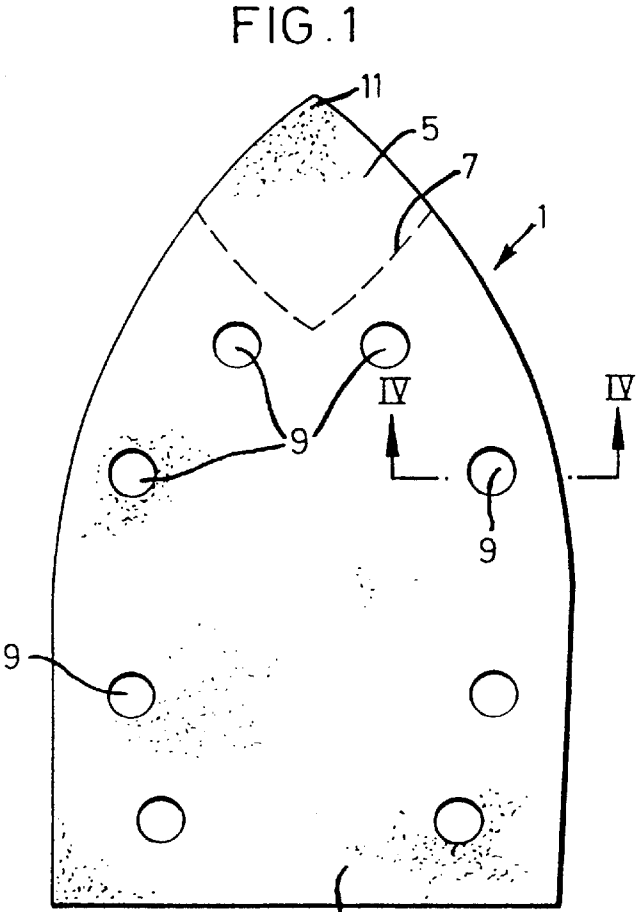
FIG. 1

ABRASIVE SHEETS

This application is a continuation of application Ser. No. 08/516,188, filed Aug. 18, 1995, now abandoned.

BACKGROUND OF THE INVENTION

1. Field of the Invention

This invention relates to abrasive sheets, such as sandpaper, glass paper or any sheet material used for sanding or polishing.

2. Description of the Prior Art

Hand-held electric sanders are well known. Many such sanders are designed to carry rectangular sand paper sheets of quarter size, third size or half size, more usually third size sheets. Although such sanders have been very popular, they have not always enabled a user to sand in tight corners, for example. Hence, sanders have been designed to accommodate triangular sheets of sand paper or sheets of sand paper having a shape similar to an iron base. Both of these sheet shapes enable the user of a sander to reach into tight corners of a workpiece to achieve complete sanding of the workpiece.

By providing a sand paper sheet which is triangular, the sheet is effectively provided with three different tips. Hence, since it is usually the tip of a sand paper sheet which wears out first, a triangular sand paper sheet can be made to last up to three times as long as a sheet with only one tip simply by removing the sheet from the base of the sander, rotating the sheet through 120° and replacing the sheet on the sander base. This can, of course, be done twice before the three tips of the sand paper sheet are worn out.

In contrast to a triangular sand paper sheet, the iron-shaped sand paper sheet has only one tip for use in tight corners of a workpiece. The sheet does, however, in general have a greater surface area than a triangular sheet which can be useful when a significant amount of plane sanding is also required. Further, the rounded edges of the iron-shaped sheet in the regions approaching the tip of the sheet enable the sander to work up close to a surface perpendicular to the work surface being sanded by the sander, by virtue of the sander "rolling" along the perpendicular surface.

SUMMARY OF THE INVENTION

In view of the foregoing, the present invention aims to improve upon the known prior art iron-shaped sanding sheets by providing a sheet having a plurality of tips.

According to the present invention, there is provided an abrasive sheet for a sanding or polishing machine, comprising a body portion and a tip portion providing a working point, the tip portion being defined by a weakened region between the body portion and the tip portion, wherein the tip portion can be separated from the body portion, turned through an angle and re-positioned adjacent the body portion to change the working point.

By virtue of the removable tip portion, a complete sanding sheet having an iron-shape, for example, can be manufactured from a single sheet, and yet the sheet can still have more than one working point to enable the sheet to last longer, during use.

The weakened region may comprise a line of perforations. Alternatively, a score line may be drawn on the sheet, during manufacture, to define the weakened region. Other ways of producing a weakened region may, of course, alternatively be used.

The tip portion preferably includes four working areas of or points. As a result of this, an abrasive sheet according to the present invention has a third more working points than a prior art triangular abrasive sheet, for example.

If the tip portion includes four working points, the tip portion is preferably substantially square.

The tip portion preferably has sides which, when the tip portion is in position adjacent the body portion, complement the sides of the body portion to produce an iron-shaped sheet. More particularly, if the sheet is an iron-shaped sheet, the sides of the tip portion will bulge slightly outwardly to define the curvature of the sheet adjacent the working points. As mentioned above if a curved surface is provided, it enables the sanding machine to "roll" along a perpendicular wall adjacent a workpiece, thereby sanding right into the corner between the perpendicular wall and the workpiece.

Apertures may be provided in the sheet through which dust and debris can be removed by a sanding machine, during use. With this in mind, many sanding machines now incorporate dust extraction equipment, such as suction devices.

Although many different ways of attaching an abrasive sheet to a sanding or polishing machine are known, it is preferable that means are provided on one side of the sheet for attaching the sheet to a sanding or polishing machine. The attachment means may be hooks or eyes of a hook-and-loop fastening system. In such a case, the sanding or polishing machine to which the sheet is to be applied must also be provided with eyes or hooks to receive the hooks or eyes of the abrasive sheet. If a hook-and-loop fastening system is used, the tip portion of the sheet can simply be pulled away from the base of the sanding machine, turned through an angle and placed back on the base of the sanding machine. Hence, a new working point can be provided within seconds.

BRIEF DESCRIPTION OF THE DRAWINGS

A specific embodiment of the present invention is now described, by way of example only, with reference to the accompanying drawings, in which:

FIG. 1 is a plan view of an abrasive sheet according to the present invention;

FIG. 2 is a plan view of the sheet of FIG. 1 with the tip portion of the sheet separated from the body portion of the sheet;

FIG. 3 is a side view of the sheet of FIG. 1; and

FIG. 4 is an enlarged sectional side view in the direction IV—IV shown in FIG. 1.

DESCRIPTION OF THE PREFERRED EMBODIMENTS

With reference to the drawings, an iron-shaped abrasive sheet 1 comprises a body portion 3 and a tip portion 5. The sheet 1, during manufacture, is simply cut from a third-size abrasive sheet. A line of perforations 7 is also formed during manufacture to define the extent of the tip portion. The tip portion 5 is, however, still attached to the body portion 3 at the end of the manufacture of the abrasive sheet 1, so that a complete sheet is purchased by a user of a sanding or polishing machine with a pre-defined working point 11.

A plurality of apertures 9 are formed in the sheet 1 through which dust and debris can be removed by a suction device of a sanding machine, during use. The arrangement of apertures 9 will, of course, need to be designed to satisfy the suction ducts formed in the sanding machine with which the abrasive sheet is to be used.

As can be seen from FIG. 1, the tip portion 5 of the abrasive sheet 1 has edges which are shaped to complement the edges of the body portion 3 to define a complete iron-shape, as shown. Further, if the tip portion 5 is removed from the body portion 3 by tearing of the perforations 7, as shown in FIG. 2, the tip portion 5 can be rotated through an angle of, say, 90° and replaced in position adjacent the body portion 3 to produce, once again, an iron-shaped abrasive sheet 1. The working point 11 of the abrasive sheet 1 will, however, have changed.

As shown in the Figures, the tip portion 5 has four working points 11. Hence, the tip portion 5 can be rotated three times after a working point 11 has been worn out before the complete tip portion becomes useless. This is clearly a significant advantage over the triangular sheets of the prior art.

As can be seen from FIG. 4 of the drawings, the abrasive sheet 1 comprises a support medium 13, such a mesh or web, carrying on one side a layer 15 of abrasive material in a resin and on the other side a layer 17 of loops or eyes of a hook-and-loop fastening system. The hooks or eyes of the layer 17 are designed to cooperate with hooks on a base (not shown) of a sanding machine to hold the abrasive sheet 1 in position on the base of the sanding machine. By using a hook-and-loop fastening system, the tip portion 5 can easily be removed, rotated and reinstated in position on the base of the sanding machine.

Although not specifically disclosed in the drawings, tip portions 5 having two, three, five, six, seven etc working points 11 could, in theory, alternatively be used.

It will of course be under stood that the present invention has been described above purely by way of example, and that modifications of detail can be made within the scope of the invention.

What is claimed is:

1. An abrasive sheet for a sanding or polishing machine, comprising a body portion and a tip portion providing a working point, the tip portion being defined by a weakened region between the body portion and the tip portion, wherein the tip portion can be separated from the body portion, turned through an angle and re-positioned adjacent the body portion to change the working point, and wherein the tip portion has sides which, when the tip portion is imposition adjacent the body portion, complement the sides of the body portion to produce an iron-shaped sheet.

2. An abrasive sheet as claimed in claim 1, wherein the weakened region comprises a line of perforations.

3. An abrasive sheet as claimed in claim 1, wherein the tip portion includes four working areas.

4. An abrasive sheet as claimed in claim 3, wherein the tip portion is substantially square.

5. An abrasive sheet as claimed in claim 1, wherein apertures are provided in the sheet through which dust and debris can be removed by a sanding machine, during use.

6. An abrasive sheet as claimed in claim 1, wherein means are provided on one side of the sheet for attaching the sheet to a sanding or polishing machine.

7. An abrasive sheet as claimed in claim 6, wherein the attachment means are hooks or eyes of a hook-and-loop fastening system.

8. An abrasive sheet as claimed in claim 1, wherein both the body portion and the tip portion are releasably attachable to the sanding or polishing machine.

9. A method of using an abrasive sheet for a sanding or polishing machine having a platen, comprising the steps of:

attaching the sheet to said platen such that a tip portion of said sheet is releasably attached to said machine adjacent a tip portion of said platen, said sheet tip portion being capable of being repetitively reattached to and released from said platen;

separating the tip portion from said sheet and removing the tip portion from said platen;

turning said tip portion through an angle; and reattaching said sheet tip portion in its turned orientation to said platen adjacent said platen tip portion.

* * * * *